United States Patent [19]

Kibble

[11] Patent Number: 4,699,065

[45] Date of Patent: Oct. 13, 1987

[54] SUSPENSION FOR RAILWAY VEHICLES

[75] Inventor: Michael Kibble, Ross-on-Wye, England

[73] Assignee: Gloucester Railway Carriage and Wagon Co. Limited, Gloucester, United Kingdom

[21] Appl. No.: 865,901

[22] Filed: May 14, 1986

Related U.S. Application Data

[63] Continuation of Ser. No. 521,380, Aug. 8, 1983, abandoned.

[30] Foreign Application Priority Data

Aug. 6, 1982 [GB] United Kingdom ..... 8222720

[51] Int. Cl.[4] ..... B61F 5/30; B61F 3/00

[52] U.S. Cl. ..... 105/199.5; 105/224.05

[58] Field of Search ..... 105/165, 224 R, 224 A, 105/224.1, 218 R, 453, 199 R, 199 S, 199.1, 199.5, 218.1, 224.05, 224.06, 223, 157.1

[56] References Cited

U.S. PATENT DOCUMENTS

| | | | |
|---|---|---|---|
| 1,000,564 | 8/1911 | Stefan | 105/244 R |
| 2,071,831 | 2/1937 | Hanna | 105/175 A |
| 3,777,672 | 12/1973 | Schneider | 105/199.5 X |
| 4,109,586 | 8/1978 | Briggs | 105/223 |

FOREIGN PATENT DOCUMENTS

| | | | |
|---|---|---|---|
| 0829602 | 7/1949 | Fed. Rep. of Germany | 105/224.1 |
| 0965786 | 6/1957 | Fed. Rep. of Germany | 105/224 N |
| 2741252 | 3/1979 | Fed. Rep. of Germany | 105/199 S |
| 0371951 | 5/1932 | United Kingdom | 105/224 |

*Primary Examiner*—Randolph A. Reese

*Attorney, Agent, or Firm*—Young & Thompson

[57] ABSTRACT

A suspension for a railway vehicle comprises a bearing assembly for rotatably supporting an axle journal of a wheelset of the vehicle, a fore-and-aft extending beam to which the bearing assembly is connected, a linkage comprising two lever arms pivotally connected between each end of the beam and a fixed support structure on the vehicle in such manner that vertical movement of the bearing assembly, and hence the beam, relatively to the vehicle effects swinging movement of one of the lever arm, and a helical compression spring connected to each of the lever arms to oppose the swinging movement thereof. A resiliently connected traction rod may be provided to provide the required longitudinal stiffness characteristics.

4 Claims, 5 Drawing Figures

SUSPENSION FOR RAILWAY VEHICLES

This application is a continuation, of application Ser. No. 521,380, filed Aug. 8, 1983, now abandoned.

BACKGROUND OF THE INVENTION

The invention relates to suspensions for railway vehicles and particularly to a suspension suitable for use with a two-axled wagon.

The majority of two-axled railway wagons which are at present in use employ a suspension arrangement in which each bearing assembly for rotatably supporting an axle journal of a wheelset of the vehicle is connected to the underframe of the vehicle by means of a leaf spring. Such arrangement has been used successfully for many years and is characterized by its cheapness and simplicity. However, one major disadvantage of such an arrangement is that the leaf springs are subjected to considerable stress and wear during use and therefore have only a comparatively short life and must be replaced at frequent intervals. The present invention sets out to provide an alternative suspension means which does not employ leaf springs but which may be used on vehicles where leaf spring suspension arrangements would otherwise be used, and which may even replace existing leaf spring arrangements.

SUMMARY OF THE INVENTION

According to the invention suspension means for a railway vehicle comprise a bearing assembly for rotatably supporting an axle journal of a wheelset of the vehicle, a fore-and-aft extending beam to which said bearing assembly is connected, a linkage comprising one or more lever arms pivotally connected between each end of the beam and a fixed support structure on the vehicle in such manner that vertical movement of the bearing assembly, and hence the said beam, relatively to the vehicle effects swinging movement of at least one lever arm, and spring means connected to said lever arm to oppose said swinging movement thereof.

Each said spring means may comprise a helical compression spring which is compressed upon upward movement of the bearing assembly and beam relatively to the vehicle.

The lever arm may be pivotally mounted on the associated fixed support structure, the spring means being connected between the lever arm and the support structure. Alternatively, and preferably, the lever arm may be pivotally mounted on the beam, the spring means being connected between the lever arm and a structure fixed in relation to the beam.

In the case where the lever arm is mounted on the fixed support structure each lever arm may have one end thereof connected to the adjacent end of said beam by connecting means, and the opposite end thereof connected to said spring means, the pivot axis of the lever arm being located intermediate the opposite ends thereof. Alternatively, each lever arm may have one end thereof connected to the adjacent end of said beam by connecting means, and the opposite end thereof pivotally mounted on the fixed support structure, the spring means being connected to a part of the lever arm intermediate the opposite ends thereof.

In any of the above arrangements the means connecting the ends of the beam to each lever arm may each comprise a rigid link pivotally connected at opposite ends thereof to the beam and lever arm respectively.

Damping means may be connected between the rigid link and said beam to restrain pivotal movement of the link with respect to the beam and thus effect lateral damping of the suspension.

Said damping means may comprise further spring means connected between a part movable with the link and a part movable with the beam. For example, the part movable with the link may comprise a member pivotally connected to the pivotal connection between the link and the lever arm and connected by spring means to a member fixed in relation to the beam.

In the case where the lever arm is pivotally mounted on the beam, the linkage may further comprise a rigid link pivotally connected at opposite ends thereof to the lever arm and fixed support structure respectively.

DETAILED DESCRIPTION OF THE PREFERRED EMBODIMENTS

Figure 1:
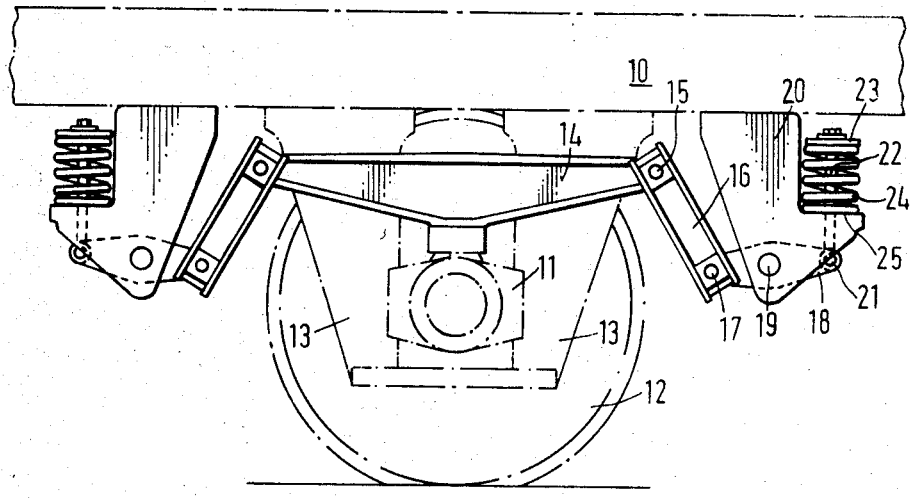
FIG. 1 is a diagrammatic side elevation of a rail vehicle suspension according to the invention.

Referring to FIG. 1, the underframe of a railway wagon is indicated at 10. in conventional manner the bearing assembly 11 for rotatably supporting the axle journal of a wheelset 12 is vertically movable with respect to downwardly extending pillars 13 mounted on the vehicle underframe.

In a conventional leaf spring arrangement the bearing assembly 11 would be connected to the center of a leaf spring, the opposite ends of which would be connected by pivoted links to support brackets on the vehicle underframe. Although the arrangement illustrated in FIG. 1 does not employ a leaf spring, it is generally similar in overall dimensions and configuration to a conventional leaf spring suspension and may therefore be readily used on vehicles where a leaf spring suspension might otherwise be used.

In the suspension according to the invention illustrated in FIG. 1, the bearing assembly 11 is connected to a fore-and-aft extending beam 14. At each end thereof the beam 14 is pivotally connected at 15 to a rigid link 16. Each link 16 extends downwardly and outwardly from the beam 14 and is pivotally connected at its lower end, at 17, to one end of a lever arm 18 which is pivotally mounted on a support bracket 20 mounted on the vehicle underframe.

The opposite end of the lever arm 18 to the pivot 17 is pivotally connected at 21 to a vertical rod 22, the upper end of which carries a pressure plate 23. A helical compression spring 24 encircles the rod 22 between the pressure plate 23 and a support surface 25 on the support bracket 20.

The arrangement is such that as the bearing assembly 11 moves upwardly relatively to the pillars 13, the consequent upward movement of the beam 14 is transmitted through the links 16 to effect pivotal movement of the lever arms 18. The resulting swinging movement of the lever arms 18 draws the rods 22 and pressure plates 23 downwardly, compressing the springs 24.

Vertical damping for the suspension is provided by the frictional engagement between the lever arms 18 and the pivot pins 17, 19 and 21. Appropriate bearing surfaces may be located between the pivot pins and the lever arms if necessary to provide the required frictional characteristics.

Figure 2:
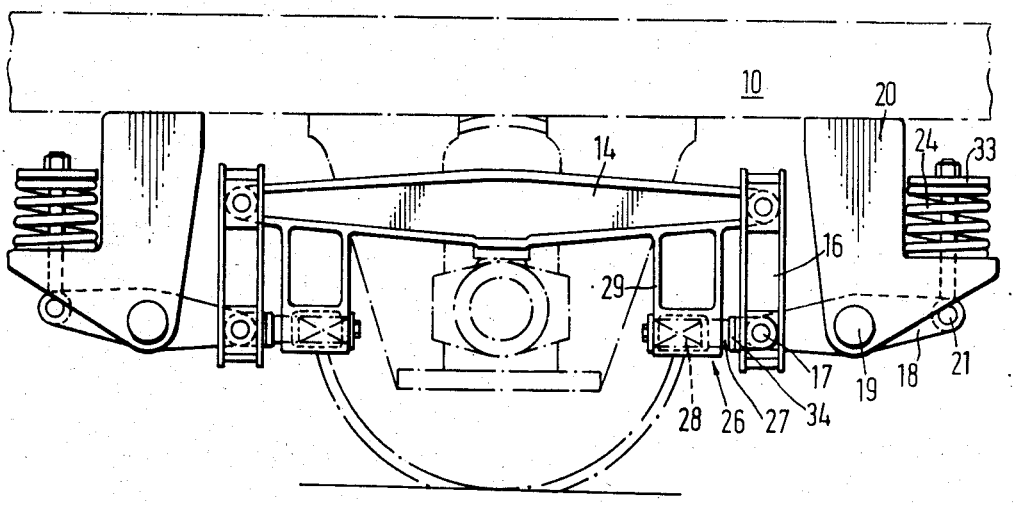
FIGS. 2 to 5 are similar views of alternative forms of suspension.

In the alternative arrangement shown in FIG. 2, damping devices 26 are provided for the purposes of part lateral damping and longitudinal stiffness. Each damping device comprises a member 34 pivotally connected to each link 16 at the pivotal connection 17 between the link and the lever arm 18. A damper pad 27 is coupled through a helical compression spring 28 to a downwardly extending pillar 29 integrally formed on the adjacent end of the beam 14. In this case each link 16 extends substantially vertically.

Figure 3:
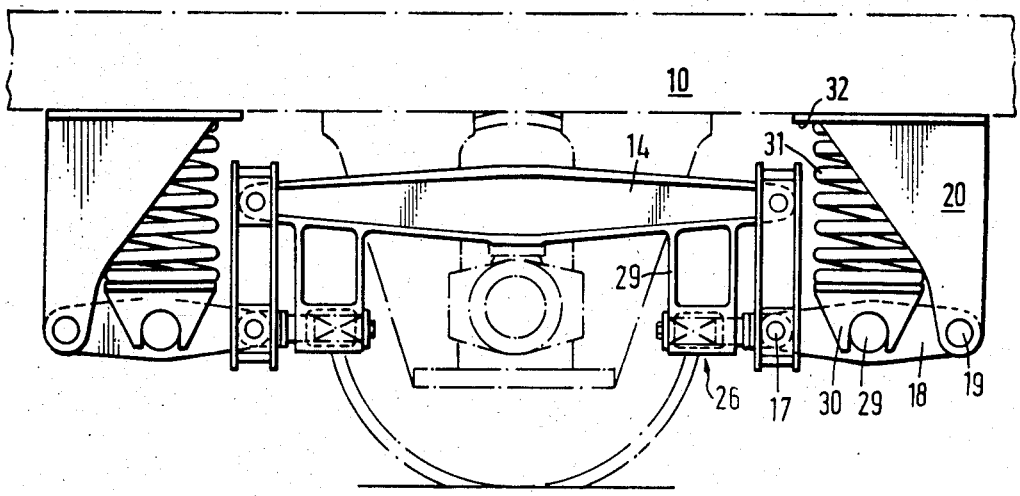

The arrangement shown in FIG. 3 is somewhat similar to that shown in FIG. 2, being provided with lateral spring damping devices 26. However, the arrangement differs from that shown in FIG. 2 in that each lever arm 18 is pivotally mounted on the support bracket 20 at the opposite end of the lever arm to the pivotal connection 17 with the link 16. In this case each lever arm 18 is provided intermediate its ends with a pivot pin 29 over which fits a saddle 30. A helical compression spring 31 is connected between the saddle 30 and a fixed support surface 32 on the support bracket 20.

The arrangement is such that upward movement of the bearing assembly and beam 14 effects upward swinging movement of the lever arms 18 about the pivots, this swinging movement causing compression of the springs 31.

Although in the above described arrangements vertical damping may, as previously mentioned, be provided by the frictional engagement between the levers and the pivot pins on which they are mounted, it will be appreciated that suitable damping means may also be provided between any moving part of the assembly and a part fixed in relation to the underframe of the vehicle.

Figure 4:
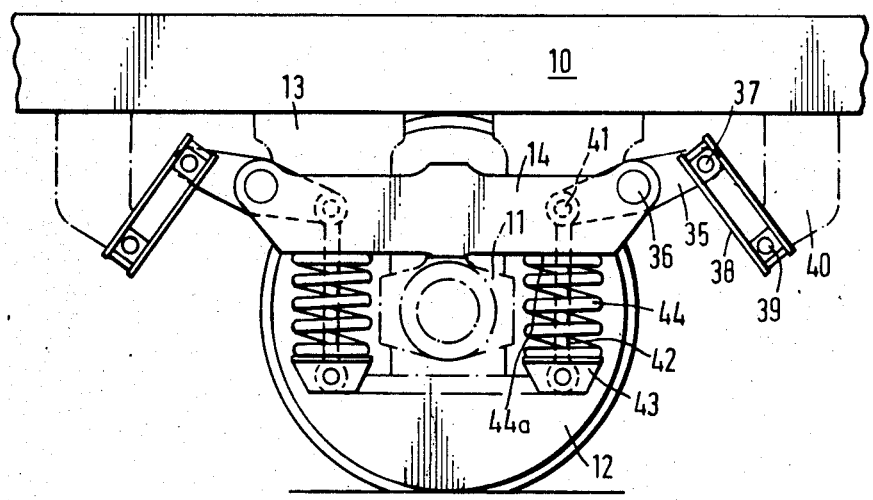

In the alternative and preferred arrangement shown in FIG. 4, lever arms 35 are pivotally connected at 36 to opposite ends of the beam 14. Each lever arm 35 is pivotally connected at 37 to one end of a rigid link 38 which is pivotally connected at the other end, as indicated at 39, to a support bracket 40 mounted on the vehicle underframe.

The opposite end of each lever arm 35 is pivotally connected at 41 to a vertical rod 42 the lower end of which carries a pressure plate 43. A helical compression spring 44 encircles the rod 42 between the pressure plates 43 and a support surface **44*a* on the underside of the beam 14**.

The arrangement is such that as the bearing assembly 11 moves upwardly relatively to the pillars 13, the consequent upward movement of the beam 14 effects swinging movement of the lever arms 35 which draw the rods 42 and pressure plates 43 upwardly with respect to the beam 14, compressing the springs 44.

Vertical damping may be provided, corresponding to the forms of damping described in relation to the embodiments of FIGS. 1 to 3.

Figure 5:
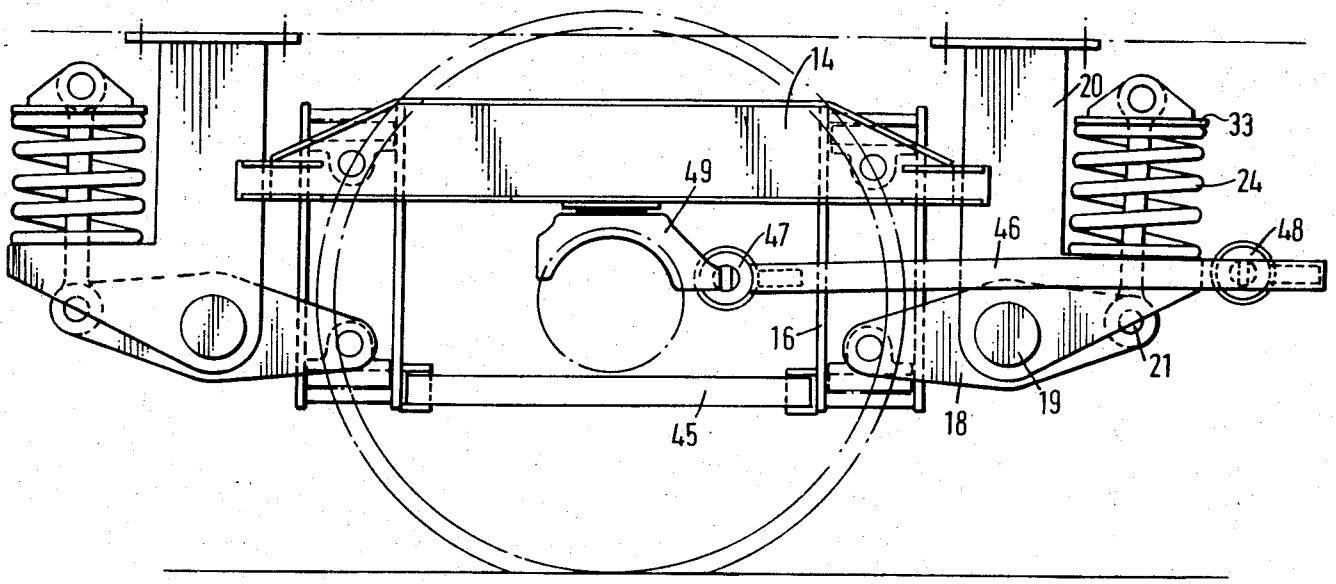

The arrangement shown in FIG. 5 is generally similar to that shown in FIG. 2, except that the spring damping devices 26 are omitted and the lower ends of the two links 16 are connected by a bar 45, the ends of which are pivotally connected to the links 16 respectively.

In order to provide the required longitudinal stiffness characteristics of the suspension assembly, a traction rod 46 is connected, by resilient end connectors 47 and 48 respectively, between the bearing saddle 49 and one of the support brackets 20 or other fixed part of the vehicle underframe.

I claim:

1. Suspension means for a railway vehicle comprising at least one wheelset including axle journals at opposite ends thereof, the suspension means comprising, at each end of the wheelset, a bearing assembly for rotatably supporting the axle journal of the wheelset at said end, a fore-and-aft extending rigid beam to which said bearing assembly is connected, a fixed support structure on the vehicle comprising two longitudinally spaced fixed support brackets, two lever arms pivotally mounted on said support brackets respectively adjacent opposite ends of the rigid beams, two rigid links each pivotally connected at one end to one of the lever arms and pivotally connected at the opposite end to the adjacent end of the rigid beam, a helical compression spring connected between each lever arm and a respective support bracket to oppose swinging movement of the lever arm, said rigid links extending downwardly from their pivotal connection with the rigid beam to their pivotal connection with the lever arms whereby said helical compression springs act to tension said rigid links, and a traction rod connected, by resilient end connection means, between the bearing assembly and one of said support brackets, said helical compression springs being the sole spring means provided in the suspension means for tensioning said rigid links, whereby said helical compression springs along provide the resilience of the suspension means through the whole range of normal operating loads thereon.

2. Suspension means according to claim 1, there being a said traction rod at each end of said at least one wheelset, the two traction rods of the suspension system being unconnected with one another whereby each traction rod contributes independently to the stiffness of the suspension system in the fore-and-aft direction.

3. Suspension means for a railway vehicle comprising a bearing assembly for rotatably supporting an axle journal of a wheelset of the vehicle, a fore-and-aft extending beam to which said bearing assembly is connected, a fixed support structure on the vehicle, two lever arms pivotally mounted on the fixed support structure adjacent opposite ends of the beam, two rigid links each pivotally connected at one end to one of the lever arms and pivotally connected at the opposite end to the adjacent end of the beam, first spring means connected between each lever arm and the support structure to oppose swinging movement of the lever arm, and spring damping means connected between a part movable with each rigid link and a part movable with the beam to restrain pivotal movement of the link with respect to the beam.

4. Suspension means according to claim 3, wherein the part movable with the link comprises a member pivotally connected to the pivotal connection between the link and the lever arm and connected by spring means to a member fixed in relation to the beam.

* * * * *